US007074173B2

(12) United States Patent
Kohlstette et al.

(10) Patent No.: US 7,074,173 B2
(45) Date of Patent: Jul. 11, 2006

(54) CENTRIFUGE HAVING A CENTRIFUGAL DRUM AND A GROOVE INCLUDING A SEAL

(75) Inventors: Werner Kohlstette, Oelde (DE); Willi Niemerg, Oelde (DE); Thomas Kleimann, Oelde (DE)

(73) Assignee: Westfalia Separator AG, Oelde (DE)

( * ) Notice: Subject to any disclaimer, the term of this patent is extended or adjusted under 35 U.S.C. 154(b) by 0 days.

(21) Appl. No.: 10/513,519

(22) PCT Filed: Apr. 25, 2003

(86) PCT No.: PCT/EP03/04291

§ 371 (c)(1),
(2), (4) Date: Nov. 4, 2004

(87) PCT Pub. No.: WO03/095096

PCT Pub. Date: Nov. 20, 2003

(65) Prior Publication Data

US 2005/0143245 A1 Jun. 30, 2005

(30) Foreign Application Priority Data

May 8, 2002 (DE) ..... 102 20 757

(51) Int. Cl.
*B04B 1/14* (2006.01)

(52) U.S. Cl. ..... 494/41; 494/70

(58) Field of Classification Search ..... 494/2–3, 494/38, 40, 41, 67–73
See application file for complete search history.

(56) References Cited

U.S. PATENT DOCUMENTS 2,873,910 A * 2/1959 Steinacker ..... 494/27
3,167,509 A * 1/1965 Steinacker ..... 494/3
3,255,958 A * 6/1966 Simon ..... 494/2
3,447,742 A 6/1969 Eriksson (Continued)

FOREIGN PATENT DOCUMENTS

DE 653 294 11/1937

(Continued)

OTHER PUBLICATIONS

Nr. 1 952 785, "Selbstreinigende Schleudertrommel mit aussbenliegendem Kolbenschieber," De. 29, 1966.

*Primary Examiner*—Charles E. Cooley
(74) *Attorney, Agent, or Firm*—Barnes & Thornburg LLP

(57) ABSTRACT

A centrifuge including a centrifugal drum that includes a centrifugal chamber and a centrifugal chamber bottom part displaceable relative to the centrifugal drum. Also included is a piston slide axially displaceably arranged to be in and/or on the centrifugal drum. At least one seal is arranged in a surrounding groove on an outer circumference of the centrifugal drum bottom part and further arranged between the piston slide and the outer circumference of the centrifugal chamber bottom part to seal off a gap between the piston slide and the centrifugal chamber bottom part. The groove is configured to be constructed at least in sections and axially open toward the centrifugal chamber.

9 Claims, 3 Drawing Sheets

U.S. PATENT DOCUMENTS

| | | | | | |
|---|---|---|---|---|---|
| 3,462,076 | A | * | 8/1969 | Steinacker | 494/27 |
| 3,568,919 | A | | 3/1971 | Nielsen | |
| 3,795,361 | A | | 3/1974 | Lee | |
| 3,885,734 | A | | 5/1975 | Lee | |
| 3,940,056 | A | * | 2/1976 | Schmidt | 494/27 |
| 4,044,945 | A | * | 8/1977 | Kohlstette et al. | 494/27 |
| 4,210,275 | A | | 7/1980 | Zettier | |
| 4,211,361 | A | * | 7/1980 | Baram | 494/40 |
| 4,245,777 | A | | 1/1981 | Lavanchy | |
| 4,284,233 | A | * | 8/1981 | Kulker | 494/27 |
| 4,288,029 | A | * | 9/1981 | Epper et al. | 494/27 |
| 4,303,192 | A | | 12/1981 | Katsume | |
| 4,322,362 | A | | 3/1982 | Kaplan | |
| 4,334,647 | A | | 6/1982 | Taylor | |
| 4,354,632 | A | * | 10/1982 | Stroucken | 494/27 |
| 4,505,698 | A | * | 3/1985 | Broker | 494/40 |
| 4,505,700 | A | * | 3/1985 | Zettier | 494/30 |
| 4,533,344 | A | | 8/1985 | Gunnewig | |
| 4,643,708 | A | * | 2/1987 | Stroucken et al. | 494/40 |
| 4,670,005 | A | * | 6/1987 | Kohlstette et al. | 494/40 |
| 4,708,711 | A | | 11/1987 | Scherer | |
| 4,717,376 | A | * | 1/1988 | Bruning et al. | 494/40 |
| 4,758,216 | A | * | 7/1988 | Wrede | 494/40 |
| 4,781,670 | A | * | 11/1988 | Kohlstette | 494/27 |
| 4,925,442 | A | * | 5/1990 | Bodelson | 494/40 |
| 5,156,751 | A | | 10/1992 | Miller | |
| 5,167,609 | A | | 12/1992 | Graw et al. | |
| 5,252,209 | A | | 10/1993 | Retter | |
| 5,306,225 | A | | 4/1994 | Miyano et al. | |
| 5,474,515 | A | | 12/1995 | Epper et al. | |
| 5,593,377 | A | | 1/1997 | Figgener et al. | |
| 5,792,037 | A | * | 8/1998 | Bodelson et al. | 494/40 |
| 5,885,202 | A | | 3/1999 | Ostkamp | |
| 6,015,375 | A | | 1/2000 | Moss | |
| 6,390,964 | B1 | | 5/2002 | Mackel | |
| 6,572,524 | B1 | | 6/2003 | Caldwell | |
| 6,648,809 | B1 | | 11/2003 | Mackel et al. | |
| 6,749,552 | B1 | | 6/2004 | Figgener et al. | |
| 6,827,680 | B1 | * | 12/2004 | Niemerg | 494/70 |
| 2004/0023783 | A1 | * | 2/2004 | Niemerg | 494/70 |
| 2005/0143245 | A1 | * | 6/2005 | Kohlstette et al. | 494/41 |

FOREIGN PATENT DOCUMENTS

| | | | | |
|---|---|---|---|---|
| DE | 657 473 | | | 3/1938 |
| DE | 1 532 678 | | | 3/1970 |
| DE | 1 908 949 | | | 9/1970 |
| DE | 1908949 | | * | 9/1970 |
| DE | 2 344 507 | | | 3/1974 |
| DE | 27 37 463 | | | 2/1979 |
| DE | 33 05 216 | | | 8/1984 |
| DE | 33 08 505 | | | 11/1984 |
| DE | 35 45 515 | | | 5/1987 |
| DE | 36 38 782 | | | 5/1988 |
| DE | 3829158 | A1 | * | 3/1990 |
| DE | 39 04 151 | | | 8/1990 |
| DE | 40 14 552 | | | 7/1991 |
| DE | 43 20 265 | | | 12/1994 |
| DE | 195 00 600 | | | 2/1996 |
| DE | 195 37 562 | | | 4/1997 |
| DE | 196 31 226 | | | 2/1998 |
| DE | 198 30 653 | | | 11/1999 |
| DE | 199 22 237 | | | 7/2000 |
| DE | 199 52 785 | | | 5/2001 |
| EP | 0 785 029 | | | 7/1997 |
| EP | 1 232 794 | | | 8/2002 |
| GB | 479007 | | | 1/1938 |
| GB | 2072055 | A | * | 9/1981 |
| JP | 10-151369 | | | 6/1998 |
| SU | 1667934 | A1 | * | 8/1991 |
| WO | WO 01/32314 | | | 2/2001 |

* cited by examiner

CENTRIFUGE HAVING A CENTRIFUGAL DRUM AND A GROOVE INCLUDING A SEAL

BACKGROUND

The invention relates to a centrifuge, particularly a separator. The centrifuge includes a centrifugal drum that includes a centrifugal chamber and a centrifugal chamber bottom part non-displaceable relative to the centrifugal drum. Also included is a piston slide axially displaceably arranged to be in and/or on the centrifugal drum. At least one seal is arranged in a surrounding groove on an outer circumference of the centrifugal drum bottom part and further arranged between the piston slide and the outer circumference of the centrifugal chamber bottom part to seal off a gap between the piston slide and the centrifugal chamber bottom part.

A separator of this type is known from German Patent Document DE 199 22 237 A1. The construction shown in this document can be operated, among other ways, with cooled sterile air as the control and cleaning fluid, and has been used particularly in areas with high hygienic requirements. However, a demand for improvement still exists with respect to hygiene in the area of the seal(s) in the gap between the axially displaceable piston slide and the centrifugal chamber bottom part and/or the centrifugal drum, in whose area deposits may occur. From German Patent Document DE 199 52 785 A1, a similar state of the art is known which results in similar problems although the seal is situated partially open in a gap.

Another state of the art device is known from U.S. Patent Document U.S. Pat. No. 4,322,362. Here, a seal is arranged on the upper edge of a drum bottom part on a step of the lower drum part constructed on the inner circumference, outside the lower drum part, a piston slide being axially movable. The seal has an upper, relatively long, free section which rests on the inner circumference of the piston slide. From a sanitary point of view, this arrangement has little advantage because a gap exists below the seal in which deposits may form. The relatively expensive seal is, among other things, not suitable for high centrifugal forces, as can be reached by modern separators (up to 3,500 g or more), since there is the risk that such high compressions of the seal on the wall to the piston slide occur which impair its function.

It is known from German Patent Document DE 653 294 to arrange a membrane between a drum bottom part and an exterior pressure ring. German Patent Document DE 1908949 A teaches the arrangement of a seal in a groove of the drum top part outside the drum, where sanitary problems inside the drum play no role.

From German Patent Document DE 33 05 216, a separator is known in which ducts, which lead to solids discharge nozzles, can be closed by a ring-shaped valve body which, on its top side, pointing to the ducts, has a groove which has an open construction axially upward and into which a seal is inserted which seals off the ducts between the drum top part and drum bottom part during the opening and closing.

SUMMARY

The present disclosure further develops the separator of the above-mentioned type such that the tendency to develop contaminations and deposits is reduced in an area where there are seals.

The present disclosure relates to a centrifuge. The centrifuge includes a centrifugal drum that includes a centrifugal chamber and centrifugal chamber bottom part non-displaceable relative to the centrifugal drum. Also included is a piston slide axially displaceably arranged to be in and/or on the centrifugal drum. At least one seal is arranged in a surrounding groove on an outer circumference of the centrifugal drum bottom part and further arranged between the piston slide and the outer circumference of the centrifugal chamber bottom part to seal off a gap between the piston slide and the centrifugal chamber bottom part. The groove, into which the at least one seal is inserted, is configured to be constructed at least in sections and axially open toward the centrifugal chamber such that the at least one seal is situated to be open at least in sections toward the centrifugal chamber. As just described, the groove, into which the at least one seal is inserted, is constructed to be axially open at least in sections toward the centrifugal chamber, and the at least one seal is situated to be axially open at least in sections toward the centrifugal chamber.

While the construction is simple, the centrifuge of the present disclosure helps in the prevention of the formation of deposits. The centrifugal material flows around the at least one seal. During a cleaning, cleaning fluid flows around the at least one seal, which, on the one hand, reduces the possibility that deposits may be formed and, on the other hand, permits the removal of possibly remaining contaminations on the at least one seal as a result of the cleaning fluid. The at least one seal is provided with a hold in the groove. A complicated shaping of the seal is not required. On the contrary, it is sufficient to use simple and cost-effective O-rings as sealing rings. The sealing rings may have a square cross-section.

As noted above, the piston slide can be displaced axially in and/or on the centrifugal drum and the centrifugal drum bottom part is non-displaceable relative to the centrifugal drum. The centrifugal chamber bottom part, for example, may be arranged in a drum bottom part. Thus, it becomes possible to reduce the formation of deposits in the gap between these two elements.

The groove may be arranged at the outer circumference of the centrifugal chamber bottom part and be constructed axially open in a surrounding manner with the exception of webs. The webs provide a good hold of the seals in the immobile centrifugal chamber bottom part. One of the webs may be shaped at preselected angular distances onto the centrifugal chamber bottom part, which secures the seal(s) against falling out of the groove in the axial direction. The seal holding function may have minimal constructive expenditures and good sanitary characteristics.

Other aspects of the present disclosure will become apparent from the following descriptions when considered in conjunction with the accompanying drawings.

DETAILED DESCRIPTION

Figure 1:
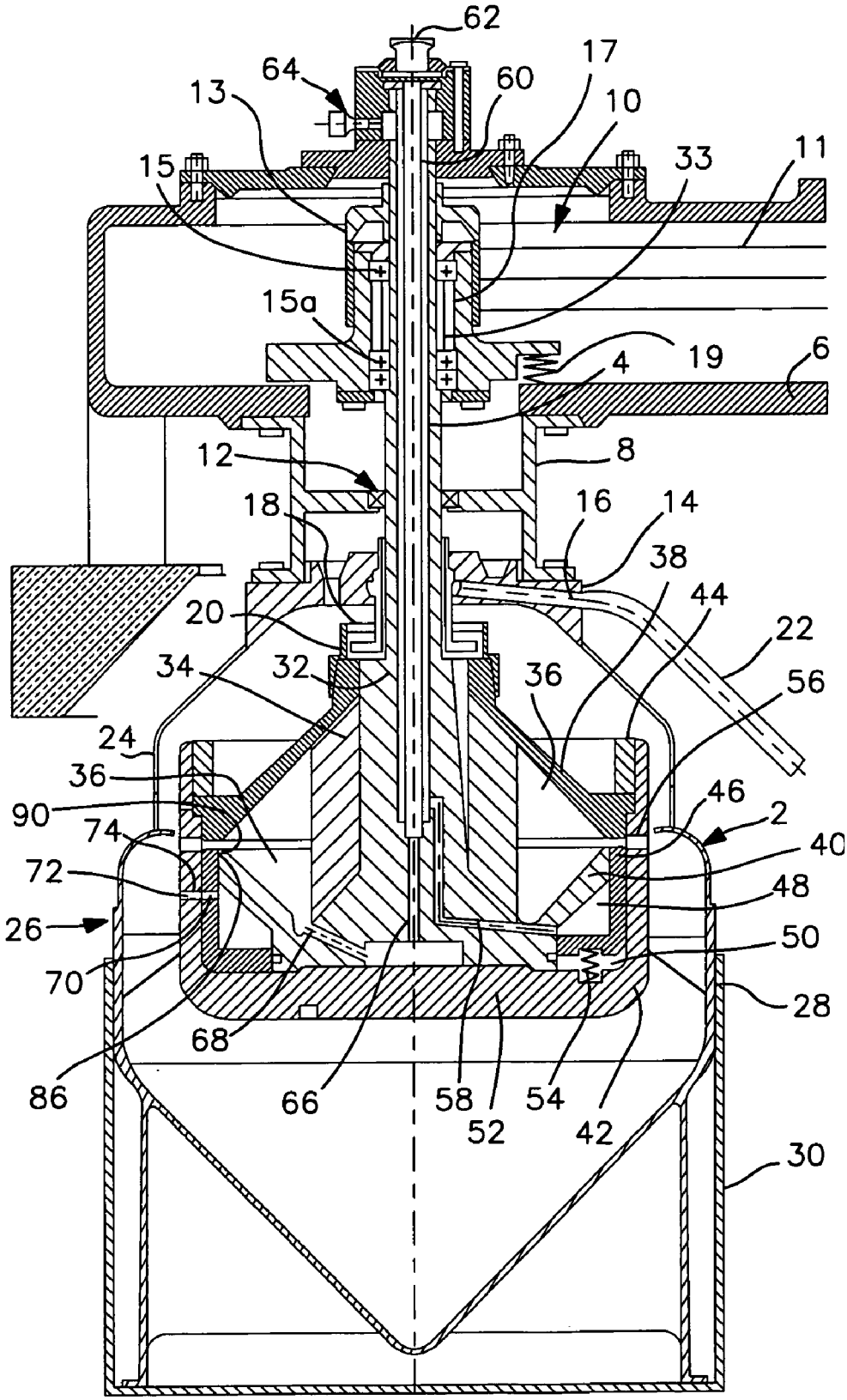
FIG. 1 is a sectional view of a centrifuge, according to the present disclosure.

FIG. 1 illustrates a centrifuge which is constructed as a separator and has a rotatable centrifugal drum 2. Centrifugal material or centrifugal liquid is guided into the centrifugal drum 2 through a central feeding pipe 4.

By its feeding pipe 4 and a projection 33 concentrically surrounding the feeding pipe 4 and a lengthened distributor 32 upward from the centrifugal drum 2, the centrifugal drum 2 is rotatably arranged or suspended on the centrifuge frame 6 with its lower frame attachment 8. In this case, a driving belt 11 of driving section 10 is wrapped around a pot-type pulley 13 which is attached to the projection 33 and takes the latter along with it. Bearings 15 and 15*a* on the outer circumference of the projection 33 permit rotations of the projection 33 in a ring 17 which surrounds the projection 33 and is supported by spring elements 19 on the frame 6.

The lower frame attachment 8 is sealed off with respect to the centrifugal drum 2 by a sealing section 12 in the frame attachment 8. A receptacle cover 14 is flanged to the lower end of the frame attachment 8 and is penetrated in the center by the feeding pipe 4. The receptacle cover 14 has an annulus which leads into an essentially radially constructed bore 16 which is used as a discharge duct for a liquid phase from the centrifugal drum 2, which is discharged by a rotary-cutting disk 18 from a rotary-cutting chamber 20. The bore 16 leads into a discharge pipe 22.

An upper outer receptacle wall 24 is shaped onto the receptacle cover 14, which receptacle wall 24 surrounds the centrifugal drum 2 in its upper area and serves as an upper end of a of a conical receptacle 26 for receiving solids, the lower section 28 of the receptacle being removable from the centrifuge in a downward direction, and stands in a receptacle frame 30.

The centrifugal drum 2 has the above-noted distributor 32 which surrounds the feeding pipe 4 and has a stack of plates 34 attached to the distributor 32 on the outside of the distributor 32. The stack of plates 34 is situated in a centrifugal chamber 36 which conically narrows in an upward and downward direction and is bounded in the upward direction by a conically shaped drum cover 38 and in the downward direction by a conically extending centrifugal chamber bottom part 40 which is shaped to the distributor 32 at the bottom of the distributor 32.

The drum cover 38 is inserted into a drum bottom part 42 and is screwed into the drum bottom part 42 by a locking ring 44.

A displaceably guided, ring-shaped piston slide 46 with an essentially L-shaped wall cross-section is arranged between the centrifugal chamber bottom part 40 and the lower housing wall of the drum bottom part 42, which L-shaped wall cross-section is adjoined by an opening chamber 48 in the upward direction and by a closing chamber 50 in the downward direction. A lower wall of the drum bottom part 42 is used as the lower closing chamber bottom 52. Between a lower wall of the piston slide 46 and the closing chamber bottom 52, thus, in the closing chamber 50, closing springs 54 may be arranged which hold the piston slide 46 in a closing position in which it closes off solids outlet openings 56 in the outer wall of the drum bottom part 42 (see right side of FIG. 1).

The opening chamber 48 is constructed between the piston slide 46 and the lower wall of the distributor 32 or the centrifugal chamber bottom part 40. A feeding of control fluid supply into the opening chamber 48 takes place via a control fluid feed 58 in the distributor 32.

The control fluid feed 58, particularly for a control gas, leads into ring-shaped feeding duct 60 surrounding the feeding pipe 4 and rotating along, between the inner wall of the distributor 32 and the feeding pipe 4 inserted in the distributor 32. An inner wall of the distributor 32 and a wall of the feeding pipe 4 form a type of "pipe with a double wall", the actual feeding duct 60 for the control fluid concentrically surrounding the feeding pipe 4 for the centrifugal material.

Above an upper end area of the centrifuge frame 6, an axial connection 62 permits the feeding of the centrifugal material into the feeding pipe 4. A connection 64, which is oriented radially to the outside, is used for feeding the control fluid, particularly the feeding of sterile control air, into the feeding duct 60 surrounding the feeding pipe or feeding tube 4.

The feeding of the centrifugal material takes place through the connection 62 and the feeding pipe 4 as well as through an axial bore 66 of the distributor 32 and a bore 68 in the centrifugal chamber bottom part 40 extending essentially radially into the centrifugal chamber 36. Solids are discharged from the centrifugal chamber 36 through openings 56. Liquid phases are discharged through the rotary-cutting chamber 20 having the rotary-cutting disk 18.

Preferably, a control gas, such as air, as the control fluid is guided through the connection 64 into the feeding duct 60 concentrically surrounding the feeding pipe 4. From there, the control air flows into the control fluid feed 58 and from there into the opening chamber 48. As a result, when a pressure buildup in the opening chamber 48 is correspondingly large, the piston slide 46 is pressed downward against the spring force of the closing springs 54, which opens the solids discharge openings 56 (see right side of FIG. 1). In contrast, a lowering of the pressure in the opening chamber 48, because of the spring force of the closing springs 54, results in a displacement of the piston slide 46 in the upward direction, which closes the solids discharge openings 56 again.

Figure 3:
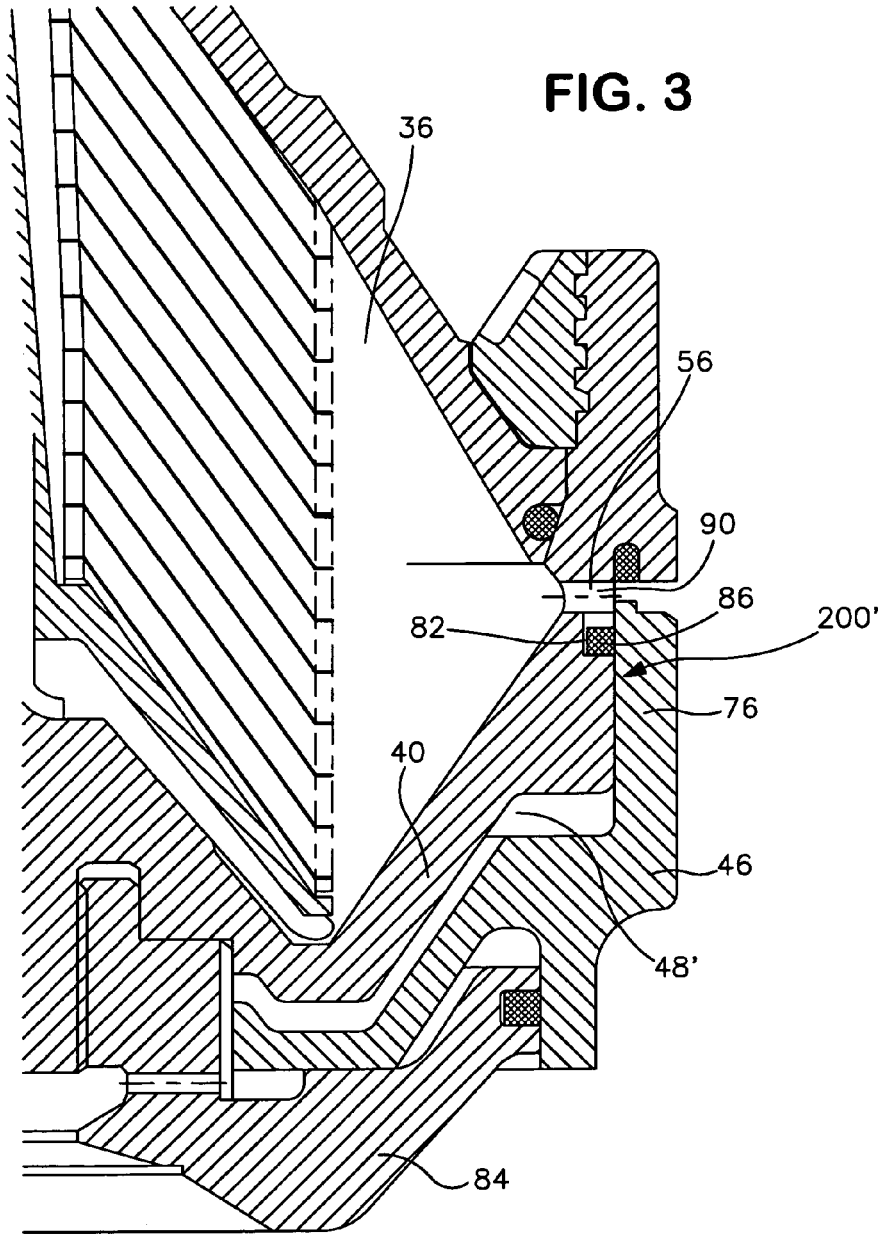
FIG. 3 is a cross-section view of a portion of a another centrifuge, according to the present disclosure.

The piston slide 46 and the outer wall of the centrifugal drum 2, as shown in FIG. 1 have passage bores 70, 72 which are in an operative connection, and at least the outer passage bore 72 being closable by a stopper 74 (see FIGS. 1 and 3).

The piston slide 46 has a cylindrical section 76 whose outer circumference rests against the inner circumference of the centrifugal drum 2. A surrounding groove 78 is constructed on the outer circumference of the cylindrical section 76. A seal 80, which also surrounds the piston slide 46, is inserted into this groove 78 and has the purpose of sealing off a gap 100 between the outer circumference of the piston slide 46 and the inner circumference of the centrifugal drum 2 (see FIG. 2).

Figure 2:
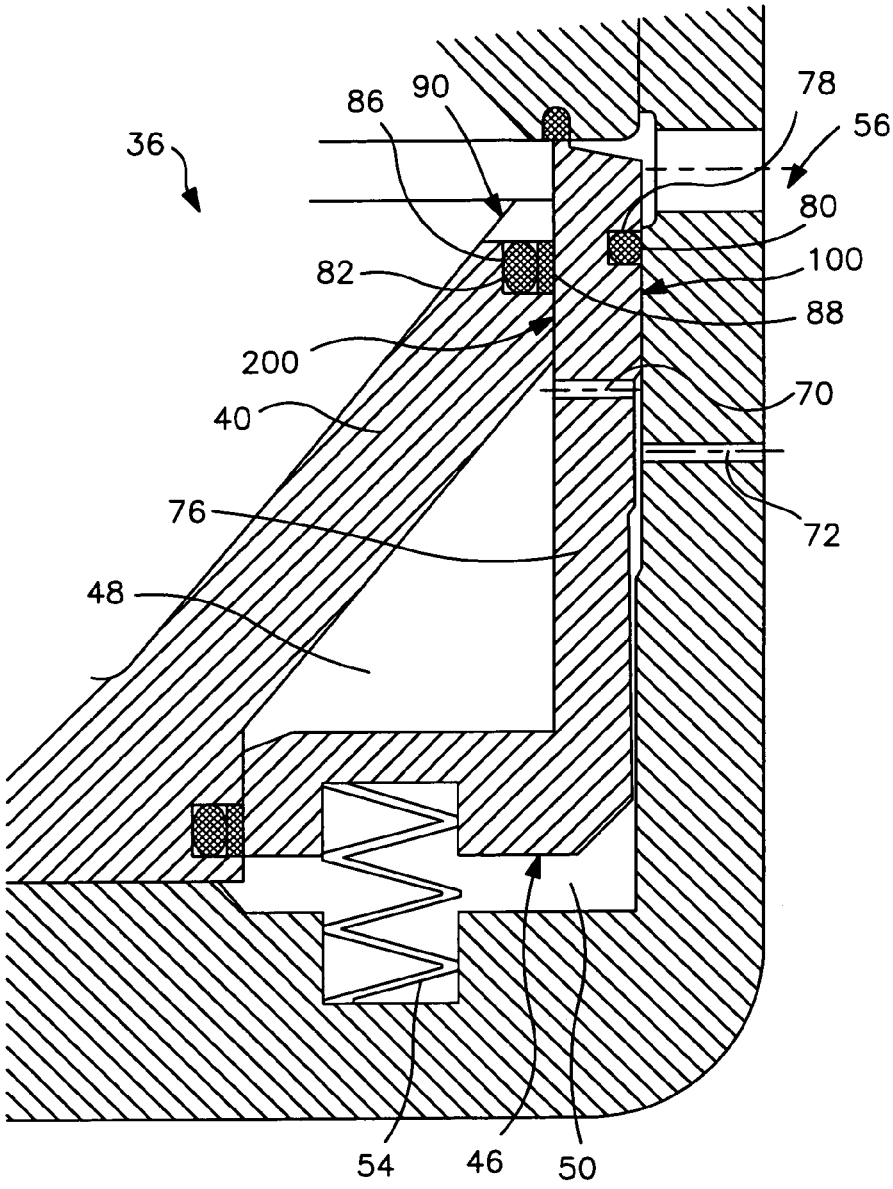
FIG. 2 is a cross-section view of a portion of another centrifuge, according to the present disclosure.

On the outer circumference of the centrifugal chamber bottom part 40, (see also FIG. 2) a surrounding groove 82 is constructed. As shown in FIG. 2, two surrounding seals 86, 88 are inserted into this groove 82, which seals 86, 88 have the purpose of separating the product chamber or centrifugal chamber 36 in the centrifugal drum 2 from a control area or the opening chamber 48 in that they seal off a gap 200 between the outer circumference of the centrifugal chamber bottom part 40 and the inner circumference of the cylindrical section 76 of the piston slide 46. As an alternative, only a single sealing ring could also be arranged in the groove 82 (not shown here).

The groove 82 is constructed on the outer circumference of the centrifugal chamber bottom part 40 at least in sections axially open in the direction of the centrifugal chamber 36 or toward the centrifugal chamber 36. However, at preselected angular distances, a radial web 90 of the centrifugal chamber bottom part 40 is also situated on the centrifugal chamber bottom part 40 in the axial direction over the two seals 86, 88 in order to prevent an unintentional falling of the seals 86, 88 out of the groove 82 during movements of the piston slide 46. One or both of the sealing ring(s) 86, 88 can be constructed as a square ring.

Since the groove 82 is situated to be axially largely open toward the centrifugal chamber 36 with the exception of the area of webs 90 distributed on the circumference, on the one hand, no centrifugal material can deposit in the gap 200 between the centrifugal chamber bottom part 40 and the inside diameter of the piston slide 46 and, on the other hand, can be easily reached by a cleaning fluid during a cleaning. This reduces a tendency to form deposits in an area of the seals 86 and 88.

For the cleaning, the cleaning fluid can be guided through control fluid paths. By way of the bore 70, the cleaning fluid also reaches the closing chamber 50 and the bore 72. Below the groove 82, additional grooves can be provided in order to accommodate additional seals and in order to further optimize the sealing function (not shown).

A bore (not shown) can also be constructed in the centrifugal chamber bottom part 40, which permits the feeding of cleaning media such as, in a CIP or Cleaning-In-Place, into the gap 200 between the centrifugal chamber bottom part 40 and the piston slide 46.

In contrast to FIG. 1, and in an embodiment shown in FIG. 3, the piston slide 46 on the outer circumference of the drum bottom part 40 and shaped onto the distributor 32 is displaceably guided relative to the drum bottom part 40, the centrifugal chamber bottom part 40 and the drum bottom part 42 being combined into one constructional element, and the piston slide 46 enclosing or surrounding the drum bottom part 40 on its outer circumference. In order to further implement control functions for operating the piston slide 46, a ring 84 is situated below the piston slide 46, which ring 84 is screwed to the drum bottom part 40. A chamber 48' for operating the piston slide 46 by pressure buildups and reductions in the chamber 48' can be provided between the ring 84 and the piston slide 46 on its underside. As an alternative, a spring support (not shown) of the piston slide 46 can be implemented on the ring 84 in the manner of the closing springs or support 54 of FIG. 2.

As shown in FIG. 3, a surrounding groove 82 is constructed on the outer circumference of the drum bottom part 40, into which groove 82 at least one surrounding seal 86 or sealing ring is inserted. This surrounding seal 86 or sealing ring has the purpose of separating the product chamber or centrifugal chamber 36 in the centrifugal drum 2 from a control area or opening chamber 48', in that seal 86 seals off a gap 200' between the outer circumference of the centrifugal chamber bottom part 40 and the inner circumference of the cylindrical section 76 of the piston slide 46. This groove 82 is also opened toward the centrifugal chamber 36, again with the exception of a few webs 90 distributed on the circumference in order to avoid deposits in the gap 200' and, on the other hand, as a result of the webs 90, to ensure a good holding of the seal 86 while maintaining a sanitary condition.

Although the present disclosure has been described and illustrated in detail, it is to be clearly understood that this is done by way of illustration and example only and is not to be taken by way of limitation. The spirit and scope of the present disclosure are to be limited only by the terms of the appended claims.

We claim:

1. A centrifuge, comprising:

a centrifugal drum including a centrifugal chamber and a centrifugal chamber bottom part non-displaceable relative to the centrifugal drum;

a piston slide axially displaceably arranged at least one of in the centrifugal drum and on the centrifugal drum;

at least one seal arranged in a surrounding groove on an outer circumference of the centrifugal chamber bottom part, the at least one seal arranged between the piston slide and the outer circumference of the centrifugal chamber bottom part to seal off a gap between the piston slide and the centrifugal chamber bottom part;

the groove, into which the at least one seal is inserted, is configured to be constructed at least in sections and axially open toward the centrifugal chamber such that the at least one seal is situated to be open at least in sections toward the centrifugal chamber; and wherein the groove is axially open except for webs.

2. The centrifuge according to claim 1, wherein, at preselected angular distances, one of the webs is shaped onto the centrifugal chamber bottom part, which secures the at least one seal against falling out of the groove in an axial direction.

3. The centrifuge according to claim 2, wherein the piston slide surrounds at least one of a centrifugal drum bottom part and the centrifugal chamber bottom part on the outer circumference.

4. The centrifuge according to claim 1, wherein the at least one seal includes a plurality of seals inserted in the groove.

5. The centrifuge according to claim 4, wherein at least one of the plurality of seals is constructed as a square ring.

6. The centrifuge according to claim 4, wherein, at preselected angular distances, one of the webs is shaped onto the centrifugal chamber bottom part, which secures at least one of the plurality of seals against falling out of the groove in an axial direction.

7. The centrifuge according to claim 1, wherein at least one seal is constructed as square ring.

8. The centrifuge according the claim 1, wherein the centrifugal chamber bottom part is combined with a centrifugal drum bottom part to form a unitary constructional element.

9. The centrifuge according to claim 1, wherein the piston slide surrounds at least one of a centrifugal drum bottom part and the centrifugal chamber bottom part on the outer circumference.

* * * * *